US009790938B2

(12) United States Patent
Clifton et al.

(10) Patent No.: US 9,790,938 B2
(45) Date of Patent: Oct. 17, 2017

(54) PUMP MONITORING SYSTEM AND METHOD

(71) Applicant: Isis Innovation Limited, Oxford (GB)

(72) Inventors: David Clifton, Oxford (GB); Patrick Thomson, Oxford (GB); Farah Colchester, Oxford (GB); Heloise Greeff, Oxford (GB)

(73) Assignee: OXFORD UNIVERSITY INNOVATION LIMITED, Oxford (GB)

( * ) Notice: Subject to any disclaimer, the term of this patent is extended or adjusted under 35 U.S.C. 154(b) by 112 days.

(21) Appl. No.: 14/856,705

(22) Filed: Sep. 17, 2015

(65) Prior Publication Data

US 2016/0076535 A1 Mar. 17, 2016

(51) Int. Cl.

| | |
|---|---|
| ***F04B 51/00*** | (2006.01) |
| ***F04B 47/00*** | (2006.01) |
| ***F04B 49/06*** | (2006.01) |

(52) U.S. Cl.

CPC ..... *F04B 51/00* (2013.01); *F04B 47/00* (2013.01); *F04B 49/065* (2013.01)

(58) Field of Classification Search

CPC F04B 33/00; F04B 47/0024; F04B 2201/121; F04B 51/00; F04B 2201/0201

See application file for complete search history.

(56) References Cited

U.S. PATENT DOCUMENTS 5,996,691 A 12/1999 Norris
6,041,856 A * 3/2000 Thrasher ..... E21B 43/121 166/53
2002/0123856 A1* 9/2002 Eryurek ..... G05B 23/0243 702/140
2008/0010020 A1 1/2008 Ellender et al.
2008/0067116 A1 3/2008 Anderson et al.
2010/0101774 A1 4/2010 Ocondi et al.
2015/0110645 A1* 4/2015 Wu ..... F04B 33/005 417/63

FOREIGN PATENT DOCUMENTS

CN 103061749 4/2013
WO WO 9738207 10/1997

OTHER PUBLICATIONS

Great Britain Search Report Application No. GB1416431.3 dated Feb. 23, 2015, 5 pages.

* cited by examiner

*Primary Examiner* — Clayton E Laballe
*Assistant Examiner* — Dennis Hancock
(74) *Attorney, Agent, or Firm* — Thomas | Horstemeyer, LLP

(57) ABSTRACT

A system for monitoring the operation of a surface pump such as a hand-operated water pump or oil pump, which uses an accelerometer mounted to a component of the pump to monitor movement of a pump component, for example the handle, and transmitted via a data connection such as a mobile data communications network to a server. The accelerometer measurements are processed by using a trained model such as a support vector machine to output an indication of the condition of the pump or the level of liquid in the well or borehole served by the pump. The model may be trained using a training data set of sensor measurements associated with liquid level in the well and condition of the pump.

20 Claims, 5 Drawing Sheets

PUMP MONITORING SYSTEM AND METHOD

CROSS-REFERENCE TO RELATED APPLICATION

This application claims the benefit of and priority to GB application 1416431.3, filed 17 Sep. 2014, the contents of all of which are incorporated herein by reference in its entirety.

TECHNICAL FIELD

The present disclosure relates to a system for monitoring surface pumps, to pumps incorporating such a system and to methods of monitoring such pumps.

BACKGROUND

Surface pumps are used in a variety of applications for raising liquid from a well or borehole to surface level. For example such pumps may be used to provide drinking water to communities, particularly in the developing world, with lever-action reciprocating handpumps such as the Afridev pump or India Mark II being the most common types. Onshore oil deposits where the deposit does not create sufficient pressure to drive oil to the surface may also use a piston pump (for example of the nodding donkey type) to raise oil to the surface.

The maintenance of such pumps in the field present challenges because the network of pumps in use is often distributed over large regions sometimes with insufficient local capacity for timely repairs. In the case of hand operated water pumps, although they offer significant benefits over open wells by providing a high discharge rate and avoiding the health problems associated with open wells, it can be difficult to arrange for local maintenance and repair and the health, economic and time consequences of a pump becoming inoperable are serious for the local community. Although the same social issues do not arise with surface pumps in oil fields, nevertheless providing for efficient maintenance and avoiding down time is still economically important.

In 2012 a "smart hand pump" was developed and tested in sub-Saharan Africa. This was based on the incorporation of a consumer-grade, low-cost IC-based accelerometer, such as those found commonly in mobile phone handsets and games controllers, enclosed in an inexpensive waterproof container and securely fitted into or onto the handle of a standard hand pump. The accelerometer was connected to a low power microprocessor programmed to estimate from the accelerometer output signal by measuring the number of pumping strokes and the range of pump movement. The data acquired was then automatically transmitted over the domestic mobile telecommunications network as an SMS text message to a control server which allowed identification of the location of the pumps and an indication of the usage patterns of any individual pump. While usage data was, in itself, of interest, the monitoring of usage also allowed the detection of inoperable pumps so that a maintenance team could be dispatched.

Although the smart hand pump was a useful step forward, it only provided crude usage data and could only alert to a faulty pump after it had become inoperable or unused, or a major fault had developed.

As surface pumps are used to access underground resources, it is always of interest to monitor the level of those resources. For example, in the case of water supply it is important to monitor the aquifer level in order that adequate supply for the community can be ensured in the long term, or because lowering aquifer levels are associated with increased salinity or higher concentrations of undesirable elements or compounds. In the case of an oil field, monitoring the level of oil allows the productivity and lifetime of the field to be monitored. Traditionally such monitoring is achieved by disposing a sensor down the well or borehole, for example an electrical conductivity sensor. This can be done on an occasional basis (as "dipping the well"), or in some cases level sensors can be permanently disposed in the well. It is expensive, however, to provide permanent level sensing in wells, and retrofitting level sensing, especially in the case of water wells, can risk damaging the integrity of the well and potentially contaminating it. Providing sensors capable of automated operation and which can be remotely monitored is also expensive.

SUMMARY

The present disclosure provides a monitoring system for a surface pump which can be incorporated into the pump, either on manufacture or as a retrofit, and which can provide information on the condition of the pump and on the level of liquid in the well on a non-invasive basis, i.e. without needing any sensor disposed down the well or borehole. In one embodiment this is achieved by monitoring an operating parameter of the pump itself, such as the acceleration or vibration of a component of the pump or a liquid pressure in the pump, the inventors having found that these parameters vary with the level of liquid in the well. Similarly, monitoring these parameters can provide an estimate of the condition of the pump and in particular can detect when the condition of the pump changes significantly, for example departs from a predefined normal condition.

In the case of a water handpump the processor can also be adapted to output an indication relating to the user of the pump, for example whether the user is adult or child, male or female, it having been found that these different types of user tend to operate the pump in subtly different ways which are detectable in the measured pump operating parameters. Monitoring the user is of interest because, for example, school attendance for girls is a particular problem in remote areas of developing countries and water collection duties become more time-consuming when handpumps fail.

One aspect of the present disclosure therefore provides a monitoring system for a surface pump for raising liquid from a well, the monitoring system comprising: a sensor mountable on the surface pump for measuring an operating parameter of the pump and providing an output signal representative thereof; a signal processor for receiving the sensor output signal and processing it to derive therefrom an estimate of the level of liquid in the well.

The signal processor can utilise a trained model or inference engine such as a support vector machine, artificial neural network or kernel-based machine which takes the output of the sensor and provides an output indicative of the level of liquid in the well.

Another aspect of the present disclosure provides a monitoring system for a surface pump for raising liquid from a well, the monitoring system comprising: a sensor mountable on the surface pump for measuring an operating parameter of the pump and providing an output signal representative thereof; a signal processor for receiving the sensor output signal and processing it by means of a trained model, inference engine or the like, to derive therefrom an estimate of the condition of the pump. By training the model on normal pump operating data, departures from normality can be detected and these can give an early indication of the condition of the pump deteriorating. This can allow preventative maintenance to be carried out, reducing or eliminating breakdowns of the pump.

The trained model can be a classifier such as a support vector model, artificial neural network or kernel-based machine though other types of machine learning algorithm can be used. The term "trained model" will be used hereafter to encompass inference engines and other machine learning techniques.

The sensor output is typically a time series of measurements. Preferably to present the sensor output signal to the signal processor the time series is subjected to a feature extraction process. For example a sensor output recording can be divided into individual sections and for each section a feature vector which describes the shape of the waveform in that section can be created. The feature vector can also include an estimate of the amount of noise in the section. The sections may correspond to individual cycles of a periodic sensor output signal or to predetermined time periods. For example if the sensor is measuring the acceleration of the pump handle of a water pump, this being a roughly sinusoidal signal but with varying amplitude and period, each individual cycle can be divided into a predefined number of subsections and a feature vector created consisting of the value of the waveform at some point within each sub-section and the average noise within each subsection. In this way the characteristics of each cycle are described in a consistent way (i.e. the feature vector has the same number of components) despite the variation in amplitude and period.

The trained model may be trained using a training set of data consisting of recordings of the sensor output for the pump with a variety of known liquid levels in the well and methods of training such models are well known in the machine learning art. For training a model to monitor the condition of the pump, a training set of data using sensor recordings for normal pumps and malfunctioning pumps can be used, or a training set which comprises only normal operation can be used, this defining a normal region of operation and departures from that region by more than a preset amount can be used to indicate malfunctioning or deterioration of the pump.

Rather than using feature extraction to describe the sensor output, it is alternatively possible to use approaches which describe and model the entire waveform, such a Gaussian process classifier which is, again, trained using a training set of data and, once trained, can analyse new sensor outputs to indicate the liquid level in the well or condition of the pump.

The surface pump can be a water pump, such as a hand pump, or an oil pump. The sensor can be an accelerometer, gyroscope or vibration transducer or a pressure sensor for sensing the liquid pressure in the pump. In the case of a hand pump the sensor can be an accelerometer (or gyroscope) sensing the movement of the handle such as found in the smart hand pump described above and the output signal can give the displacement and arc of the handle.

The data processing may be carried out at the pump, this having the advantage of requiring only the output summary data to be transmitted via a communications network (such as a text message on a cellular mobile telephone network or via a data connection) saving bandwidth and reducing cost. However it is feasible for the sensor output signals, compressed or otherwise lightly-processed if desired, to be transmitted for processing at a server remote from the pump. In either situation the server can receive either the sensor output or the processed signals and display them allowing management of plural pumps disposed across a geographical region. It is also possible for the data transmitted from the pump to the server to default to relatively low resolution but to be switchable to higher resolution for more detailed investigation. Thus the communication between pump and server is preferably two-way.

By monitoring the level of water in wells or boreholes across a geographical region it is possible to obtain in a cost-effective and efficient way an indication of the level of the liquid resource in that region, for example the condition of the aquifer or oil deposit such as the magnitude and direction of the resource. With the present disclosure this is achieved without the need for direct invasive sensing of liquid levels in the wells themselves. This information is particularly valuable in a complex resource deposit, especially with two-way communication between sensor and server.

BRIEF DESCRIPTION OF THE DRAWINGS

The present disclosure will be further described by way of example with reference to the accompanying drawings in which.

DETAILED DESCRIPTION

Figure 1A:
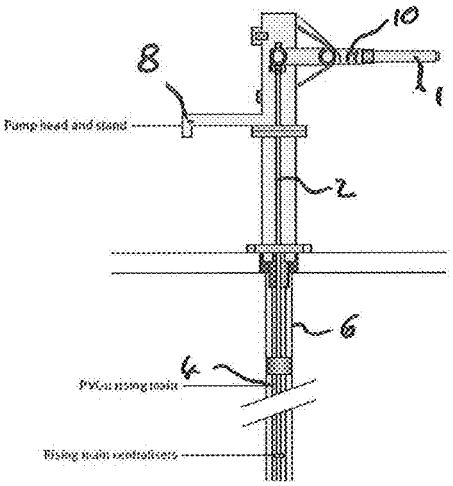
FIGS. 1A and 1B schematically illustrate the two most common designs of water hand pump.
Figure 1B:
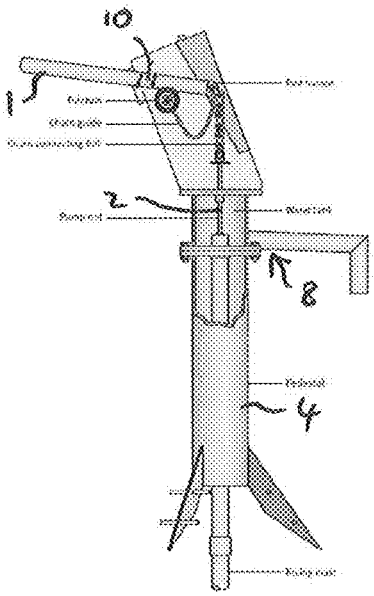
Figure 9:
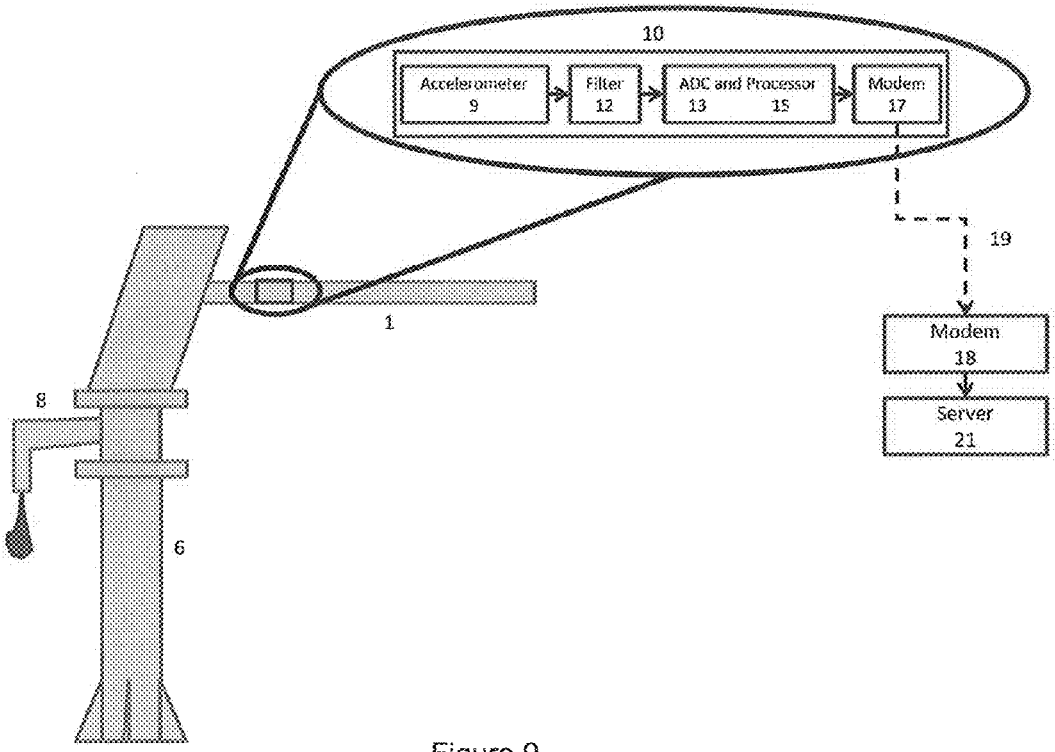
FIG. 9 is a schematic diagram of a monitoring system according to one embodiment of the present disclosure.

FIG. 1A and FIG. 1B of the accompanying drawings schematically illustrate respectively the Afridev and India Mark II types of water hand pump. These two pumps form the majority of hand pumps in use in the developing world. Both are positive displacement, piston type pumps in which a pivotably mounted handle 1 is connected either directly or with a connecting chain to a pump rod 2 which slides a non-return piston valve (not visible) in a vertical cylindrical pipe 4 fitted at its base with a foot valve. In use the vertical cylindrical pipe 4 is disposed within a well or borehole 6. Pumping the handle 1 causes vertical reciprocation of the pumping rod 2 and piston valve with upwards movement of the piston valve drawing water from the well or borehole into the cylindrical pipe 4 through the foot valve and also moving water above the piston valve (from the previous stroke) up through the pump head 8 to be dispensed. The subsequent downward movement of the piston rod 2 forces the piston valve through the water which has just been drawn in, to start the cycle again. As illustrated the pump handle 1 is fitted with a sensor fitted within a package 10 known as a waterpoint data transmitter 10 which, in this embodiment, includes a consumergrade, low-cost IC-based accelerometer such as that found in a mobile phone handset or games controller, such as an Analogue Devices ADXL335. FIG. 9 schematically illustrates the waterpoint data transmitter 10 fitted to a pump. The accelerometer 11 senses movement in the X, Y and Z directions and produces three analogue output signals proportional to the acceleration sensed along each axis. The analogue output can be filtered by a simple RC filter 12 to remove any high-frequency noise, and passed via an analogue to digital converter 13 to a data processor 15 for processing the data. Alternatively the accelerometer 11 can be a digital accelerometer obviating the need for the RC filter 12 and separate A/D converter 13. The output of the data processor 15 is passed to a modem 17 for dispatch via a data link 19, for example provided by a communications network such as the cellular mobile telephone network, and another modem 18 to a server 21.

The estimation of liquid level in the well and pump condition based on the sensor data can be carried out by the data processor 15 or at the server 21. Thus the data processor 15 can be adapted only to compress and package the sensor data to be sent via a data connection provided, for example, by mobile telephone or other communication network e.g. via an SMS text message on the GSM network, or can obtain the liquid level and pump condition data and compress and package that for transmission to the server 21 via the data connection. The explanation below applies to processing either at the server 21 or at the pump. The water point data transmitter 10 can be retrofitted to water pumps or can be fitted on manufacture.

Figure 2A:
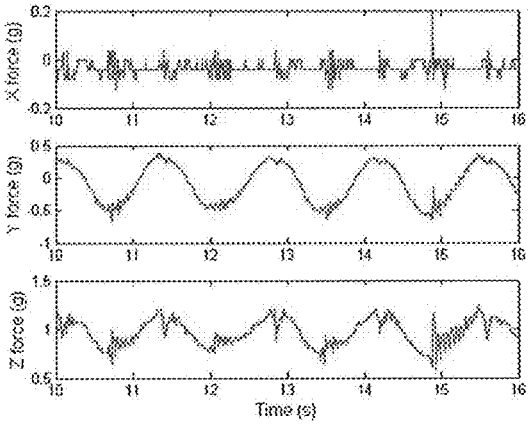
FIGS. 2A and 2B illustrate example sensor outputs for the two designs of hand pump illustrated in FIGS. 1A and 1B for an embodiment of the present disclosure utilising an accelerometer on the hand pump handle.
Figure 2B:
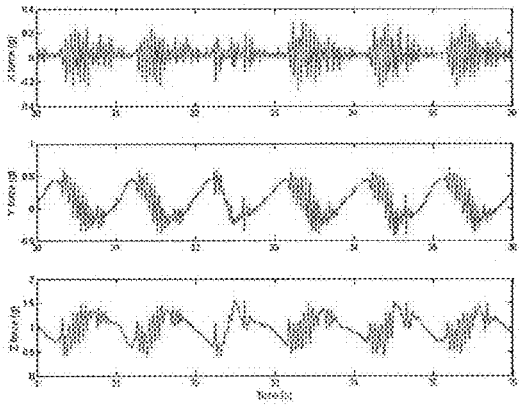

FIGS. 2A and 2B show approximately six seconds of recorded accelerometer data for each of an Afridev pump (FIG. 2A) and an India Mark II pump (FIG. 2B) for each of the three, X, and Z directions. For these recordings the Z direction corresponds to the main up and down direction of the handle, the Y direction to the longitudinal axis of the handle and the X direction transverse of the handle. There is a marked difference in the X direction recordings, this is thought to be because the India Mark II pump has a different connection between the handle and pumping rod resulting in a slightly elliptical motion of the handle. Thus the X direction for the India Mark II pump shows a greater periodicity. It can also be seen that in the Y and Z traces for both pumps the amount of noise differs between the upstroke and downstroke. This being because during the downstroke the handle is under load whereas the upstroke is a lower load return stroke.

Figure 3:
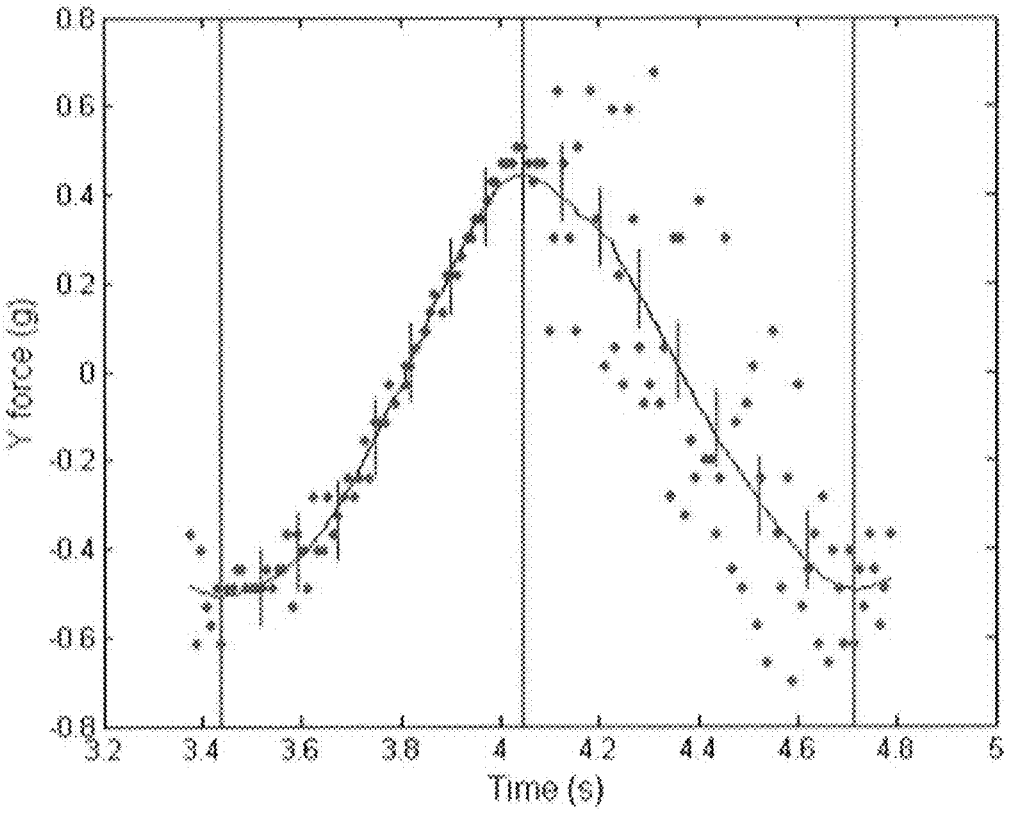
FIG. 3 illustrates an example feature extraction method according to one embodiment of the present disclosure.

In a first embodiment the sensor outputs shown in FIGS. 2A and 2B are processed to reduce their dimensionality and put them in a form which is suitable for analysis by a conventional machine learning algorithm such as a support vector machine. A preferred type of feature extraction is illustrated in FIG. 3.

The accelerometer 11 used in this embodiment has a sampling rate of 96 Hz, meaning that it provides 96 acceleration measurements per second (per axis). FIG. 3 shows magnified one period from one axis of the recording of FIG. 2B with the individual acceleration samples shown as dots. The aim is to express the recording as a combination of a smooth underlying waveform together with noise, i.e.:

$$x=f(t)+\epsilon$$

where $f(t)$ is the function describing the underlying waveform and $\epsilon$ is the noise. For the function $f(t)$ a smoothing spline can be selected which minimises the weighted sum of the function fluctuation and the corresponding mean square error as shown in the equation below:

$$\Sigma_{i=1}^{n}(x_i-s(t_i))^2+(\lambda-1)\int_t[s''(t_i)]^2dt$$

where s is the point on the smoothing spline that minimises the function.

The smoothing parameter $\lambda$ controls the complexity of the spline that is fitted to the data. For this embodiment a value of $\lambda=0.002$ was selected, though the results are relatively insensitive to changes in $\lambda$.

Having fitted the spline to the data, the noise can be taken as the distance between each original data point and the spline.

A feature vector for this cycle (cycles can easily be recognised by detecting the maxima or minima) can then be formed by dividing the cycle into, for example, p=16 intervals as shown by the short vertical lines, taking the value of the spline at each of the interval boundaries and taking an estimate of the noise in each interval as the sum of the distances between the original data points and the spline in that interval. Thus in this example each feature vector consists of 16 spline values and 16 noise values. Each of the feature vectors for a complete recording thus represents a point in a 32 dimensional "feature vector space". It should be appreciated that by dividing the sensor output into cycles and dividing each cycle into an equal number of intervals, the method is effectively distorting the time base to allow for different timing of pump operation by different users or in different circumstances.

Typically water pump handles are operated at about 1 Hz, thus each axis of the sensor output provides typically one feature vector per second, each feature vector having 32 components, though the method works for any cycle length. It should also be noted that other aspects of the signal can be added to the feature vector. For example the cycle length can be informative, it goes up if the aquifer is low because of the extra effort required, and can go down if the pump is leaky, and so period length can be added as a component of the feature vector.

The feature vectors thus provide a representation of the sensor output recording which can be analysed by a machine learning algorithm.

Figure 4A:
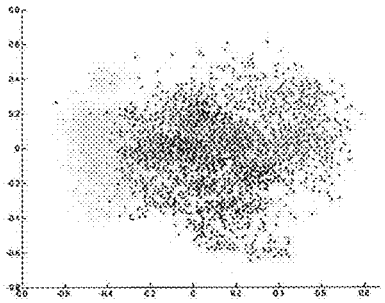
FIGS. 4A and 4B are visualisations of feature vectors corresponding to recordings of a variety of hand pumps.
Figure 4B:
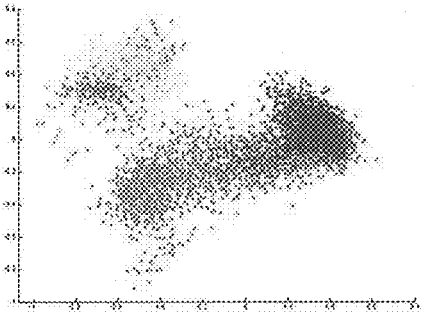

FIGS. 4A and 4B illustrate respectively the feature vectors from the recordings of FIGS. 2A and 2B but with their dimensionality reduced to two dimensions for easy visualisation by means of Sammon's mapping. Sammon's mapping is a visualisation technique which tries to preserve the relative spacings of high dimensional feature vectors in a low dimensional display (in this case two dimensional). It can be seen from FIGS. 4A and 4B that the feature vectors from different recordings group together demonstrating that the feature vector representation of the recordings preserves the useful information in the recordings. It should be noted that the full 32 dimensions are used in the training and monitoring discussed below—the two dimensional plots of FIGS. 4 A and 4B are just for visualisation.

With this embodiment the estimates of liquid level in the well and condition of the pump are obtained from the feature vectors by use of a trained model, in this case a support vector machine. A support vector machine is one type of machine learning algorithm, but other types can be used. The model must first be trained on a training set of data for which the desired output (i.e. the liquid level or pump condition) is known. Once the support vector machine has been trained on a training data set, it can be presented with new feature vectors and it will output an estimate of the liquid level or pump condition.

Rather than a support vector machine, other machine learning algorithms can be used such as neural networks or kernel-based machines. Techniques for training these on a training data set, validating them and using them to classify further data are well known.

Figure 5A:
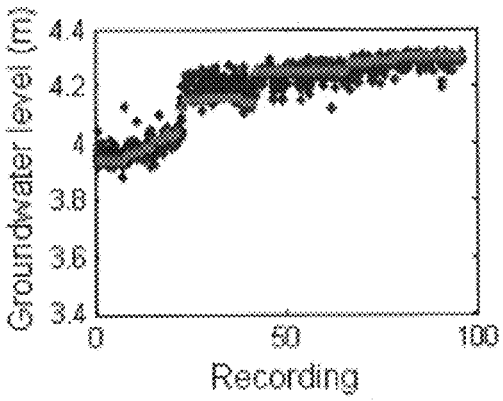
FIGS. 5A and 5B compare estimates of water level in a well obtained by an embodiment of the present disclosure with water levels measured directly.
Figure 5B:
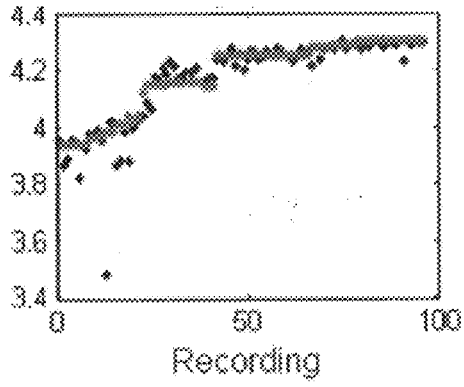

FIGS. 5A and 5B illustrates the results of ground water level predictions (crosses) and measured level (lighter dots) with FIG. 5A being the individual spline estimations (i.e. one for each cycle) and FIG. 5B showing the average estimation from each recording. It can be seen that there is good agreement between the estimations and the directly measured level.

Figure 7:
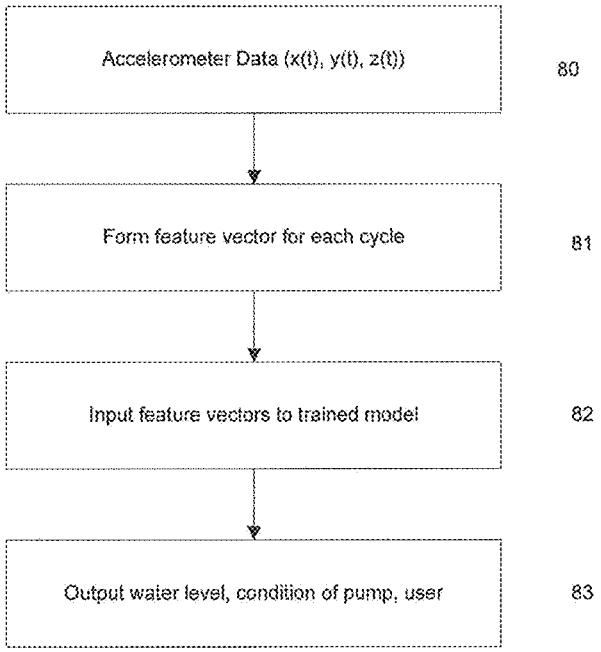
FIG. 7 is a flow diagram of the method according to one embodiment of the present disclosure.
Figure 8:
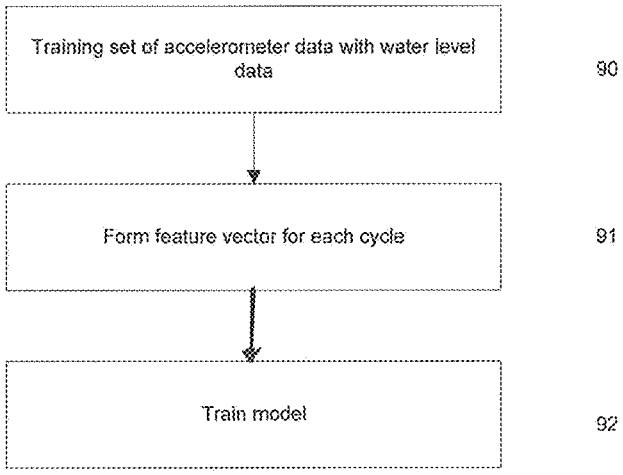
FIG. 8 is a flow diagram of a method of training a model according to one embodiment of the present disclosure.

FIGS. 7 and 8 summarise the test and training aspects of this embodiment. As illustrated in FIG. 8 in step 90 a training set of accelerometer data is taken together with measured water level data. For each of the cycles of accelerometer data a feature vector is created in step 91 as explained above and these feature vectors together with the measured water levels are used in step 92 to train the model (such as the SVM above).

For monitoring performance, as shown in FIG. 7, accelerometer data is taken in step 80 and in step 81 is formed into feature vectors for each cycle as before. These feature vectors are input in step 82 to the trained model, which in step 83 outputs the water level and any other aspects which it has been trained to distinguish, such as the pump condition or the user. Training for other aspects corresponds to the training process of FIG. 8. Training to detect the condition of the pump can either utilise data from pumps which are known to be faulty (for example by fitting them with faulty components), or can follow a novelty detection approach in which the distance of a feature vector from a predefined region of normality in the multi-dimensional feature vector space (32 dimensions in the embodiment above) is calculated and, if it is greater than a preset threshold, a malfunction alarm is generated. The region of novelty may be defined by using a training data set of recordings of pumps known to be in normal operation. The distance of an input feature vector from the region of normality can be calculated as the distance from the centroid of the normal feature vectors or the distance from a certain number of nearby feature vectors. Similarly training to distinguish users can be based on a training data set consisting of recordings from different users such as male adult, female adult, child etc.

Figure 6A:
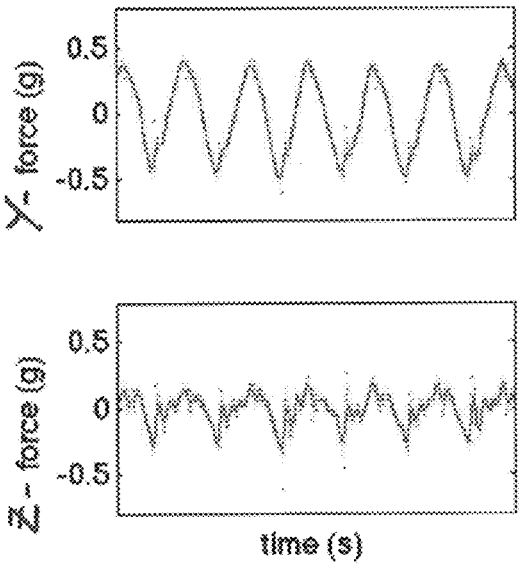
FIGS. 6A and 6B illustrate heteroscedastic Gaussian processes fitted to sensor data from a water hand pump.
Figure 6B:
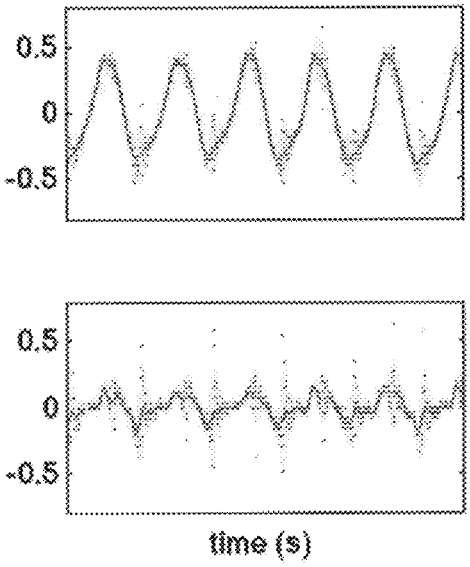

The embodiment above uses feature extraction to reduce the dimensionality of the input data and a machine learning algorithm such as a support vector machine. However, alternative approaches are possible, for example the entire waveform can be described using a Gaussian process model thus obviating the need for feature extraction. Gaussian process models are trained using a training data set and thus can classify input data to output estimations of liquid level, pump condition, user as before. FIGS. 6A and 6B illustrate Gaussian processes fitted to a 15 second interval of data from an Afridev pump for the Y axis (top) and Z axis (bottom). FIG. 6A is data from a deep well and FIG. 6B from a shallow well. In each case the data points from the accelerometer are shown as dots and the fitted Gaussian process shown as a line.

Therefore, the following is claimed:

1. A system for monitoring a surface pump for raising liquid from a well, the monitoring system comprising:

a surface pump comprising a handle for operating the pump;

a sensor mounted on or associated with the handle, wherein the sensor is configured to sense movement of the handle and provide an output signal representative thereof; and a signal processor for receiving the sensor output signal and processing it to derive therefrom an estimate of the level of liquid in the well or an estimate of the condition of the pump or both.

2. The system according to claim 1, wherein the signal processor comprises a trained model for deriving the estimate of the level of liquid or the condition of the pump, or both, from the output signal from the sensor.

3. The system according to claim 2, wherein the trained model comprises a classifier.

4. The system according to claim 2, wherein the trained model comprises a support vector machine, artificial neural network, kernel-based machine or Gaussian process classifier.

5. The system according to claim 1, wherein the signal processor is adapted to extract a plurality of features from successive periods of the output signal and form them into a feature vectors respectively representing the output signal in the successive periods.

6. The system according to claim 5, wherein the signal processor is adapted to form a feature vector for each cycle of a periodic output signal from the sensor.

7. The system according to claim 6, wherein the signal processor is adapted to divide each cycle into a plurality of segments and to form as the feature vector for that cycle the values of the underlying waveform of the output signal at a predetermined position in each segment together with an estimate of the noise in each segment.

8. The system according to claim 7, wherein the signal processor is adapted to divide each cycle into the same number of segments whereby the duration of each segment may vary from cycle to cycle.

9. The system according to claim 1, wherein the system comprises a surface pump and a monitoring system, wherein the monitoring system comprises the sensor and the signal processor.

10. The system according to claim 1, wherein the surface pump is one of: a water pump, an oil pump, a hand pump, or a reciprocating pump.

11. The system according to claim 1, wherein the sensor is an accelerometer, pressure sensor or vibration transducer.

12. The system claim 2, wherein the sensor is an accelerometer, pressure sensor or vibration transducer.

13. The system according to claim 1, wherein the signal processor processes the output signal to classify at least one of: the condition of pump, or the user of the pump.

14. The system according to claim 1, further comprising a data transmitter for sending data from at least one of the sensor and the signal processor via a data communications link.

15. A method of monitoring a surface pump for raising liquid from a well, the method comprising:

measuring movement of a handle of the pump and providing an output signal representative thereof;

receiving the output signal and processing it to derive therefrom an estimate of the level of liquid in the well, or an estimate of the condition of the pump or both.

16. The method according to claim 15, wherein the output signal is processed to derive the estimate of the level of liquid in the well or the condition of the pump by means of a trained model.

17. The method according to claim 16, wherein the trained model comprises a classifier, support vector machine, artificial neural network, kernel-based machine or Gaussian process classifier.

18. The method according to claim 15, comprising the steps of extracting a plurality of features from successive periods of the output signal and forming them into a feature vectors respectively representing the output signal in the successive periods.

19. The method according to claim 18, wherein each successive period is divided into a plurality of segments and the feature vector for that period is formed by the values of the underlying waveform of the output signal at a predetermined position in each segment together with an estimate of the noise in each segment.

20. The system according to claim 1, wherein the sensor is an accelerometer or vibration transducer.

* * * * *